United States Patent [19]

Borcoman

[11] 4,290,740

[45] Sep. 22, 1981

[54] ROTARY DRUM PLANT FOR THE MANUFACTURE OF CONCRETE, REINFORCED CONCRETE AND/OR PRESTRESSED CONCRETE PRODUCTS

[76] Inventor: Mircea Borcoman, 8, rue des Dardanelles, 75017 Paris, France

[21] Appl. No.: 94,679

[22] Filed: Nov. 15, 1979

[30] Foreign Application Priority Data

Nov. 22, 1978 [FR] France ..... 78 32891

[51] Int. Cl.[3] ..... B28B 5/04; B28B 5/10; B28B 3/00; B28B 13/05; B28B 23/04

[52] U.S. Cl. ..... 425/62; 425/88; 425/111

[58] Field of Search ..... 425/61, 62, 88, 111

[56] References Cited

U.S. PATENT DOCUMENTS 3,720,493 3/1973 Borcoman et al. ..... 425/111
3,732,044 5/1973 Borcoman ..... 425/111
4,061,454 12/1977 Borcoman ..... 425/88
4,197,623 4/1980 Suzuki et al. ..... 425/62 X

*Primary Examiner*—J. Howard Flint, Jr.

[57] ABSTRACT

Plant comprising a rotary drum with a horizontal rotary axis lined, over its outer cylindrical surface with molding means and adapted to pass said molding means during rotation, before various working stations such as concreting, hardening, stripping and core positioning stations. The drum is equipped with beams with a composite profile fixed, notably by welding, longitudinally on the outer periphery of the drum. The beams have a cross-section which has zones adapted to form a roller track parallel to the longitudinal axis of the drum for the rolling and guidance of compacting means for the concrete. It is equipped with fastening means for the molds in a position situated radially outwards with respect to said roller track. It also has sufficient mechanical strength to absorb the major part of the prestressing forces exerted on the cores in the case of manufacturing prestressed concrete elements.

10 Claims, 8 Drawing Figures

ROTARY DRUM PLANT FOR THE MANUFACTURE OF CONCRETE, REINFORCED CONCRETE AND/OR PRESTRESSED CONCRETE PRODUCTS

BACKGROUND OF THE INVENTION

The invention relates to a plant for the manufacture of products of concrete, reinforced concrete and/or prestressed concrete, of the type which comprise a rotary drum with a horizontal axis of rotation, lined on its outer cylindrical surface with molding means and adapted to pass, said molding means during its rotation before various working stations, notably concreting, hardening, demolding (or stripping) and core-positioning stations.

A plant of this type is known notably from U.S. Pat. No. 3,720,493.

It is a particular object of the invention to provide plants of the type concerned which respond to the various exigencies of practice better than hitherto, and notably such that they enable the production, with a minimum of adaptation, of wide diversity of types of product, and the assurance of manufacture of products of good quality.

GENERAL DESCRIPTION OF THE INVENTION

According to the invention, a plant for the manufacture of products of concrete, reinforced concrete and/or prestressed concrete, of the previously defined type, is characterized by the fact that the drum is equipped with beams with a composite profile fixed, notably by welding, longitudinally over the outer periphery of the drum, said beams:

(1) having a cross-section which has areas adapted to form a roller track parallel to the longitudinal axis of the drum for the rolling and guidance of compacting means for the concrete;

(2) being equipped with fastening means for the molds in a position situated radially outwards with respect to said roller track;

(3) having, in addition, sufficient mechanical strength to absorb the major part of the prestressing forces exerted on cores in the case of manufacture of elements of prestressed concrete.

Among the advantages obtained by means of the invention, may be mentioned the improvements in the quality of the products by reason of the improvement in the efficiency of compacting and the reduction in deformation of the molding means; in addition, the adaptation of the molding means to various types of products to be manufactured may be effected simply and rapidly, which makes the plant a multipurpose plant.

Preferably, the cross-section of each beam is composed of a substantially rectangular base portion, situated against the peripheral surface of the drum and of a T portion fastened, through its center leg, at mid-width on the base portion, the areas of the base portion situated on each side of the center leg of the T serving as a conveyor line, whilst the cross-bar of the T is designed to receive support means, notaby elastic, for molds.

Advantageously, the molding means include at their part turned towards the drum, a strengthening element extending longitudinally, providing with attachment means for the compacting means, this strengthening element as well as the attachment means being identical whatever the type of mold for the various kinds of products to be manufactured, the lower portion of the mold being connected, notably by hinges, to lateral shelves whose shape is determined by the type of product to be produced; closing covers are if necessary provided to cover the free surface of the concrete during heat treatment.

Preferably, the concreting installation includes a carriage whose length, in the direction parallel to the axis of the drum, is substantially equal to that of the drum, this carriage including two levels and being situated above the highest generator of the drum, the upper level of this carriage including at least one container to receive concrete and means for permitting the flow of the concrete into the molds, the above-mentioned carriage being adapted to roll, at its upper level, over roller means borne by a fixed frame, the above-said carriage including a second level or a lower level provided with compacting means adapted to roll over the roller track of the beams fast to the drum, attachment means being provided to lock the compacting means on the bottom of the molds during the compacting phase, the two levels of the carriage being connected by a framework, and to-and-fro means being provided to move the carriage so that it can occupy a working position for which its upper level occurs above molds stopped at the top of their path, whilst the lower level of the carriage is situated below these molds, or an output position for which the carriage is situated, in the axial direction, entirely outside the drum.

Generally, the plant includes a heat treatment installation advantageously constituted by a chamber, closed inwardly by the drum itself, outwardly, (in the radial direction) by walls, notably polygonal, at the ends along the axial direction by screens, and radially by movable curtains provided with winding, guiding and raising means, this heat treatment chamber being provided with distribution, regulating and recovery means for the thermal agent.

The installation for unmolding and removing concrete products is notably placed at 270° C. with respect to the concreting station; this unmolding and removal installation includes, advantageously, a frame adapted to be moved in a radial direction, notably in the horizontal plane passing through the axis of the drum, this frame bearing a rotary beam on which means for gripping the demolded products are mounted, this beam being rotatable, with the gripping means, so as to ensure the removal of the molded products seized by the gripping means.

The rotary drum plant may be constituted by several dismountable sub-assemblies, each sub-assembly having a gauge acceptable for transportation by road.

According to another possibility, the rotary drum plant may be mounted in the hull of a ship so as to constitute a floating plant.

The invention consists, apart from the feature mentioned above, of certain other features which will be more explicitly considered below, with regard to particular embodiments described with reference to the accompanying drawings, but which are in no way limiting.

DESCRIPTION OF PREFERRED EMBODIMENTS

Figure 1:
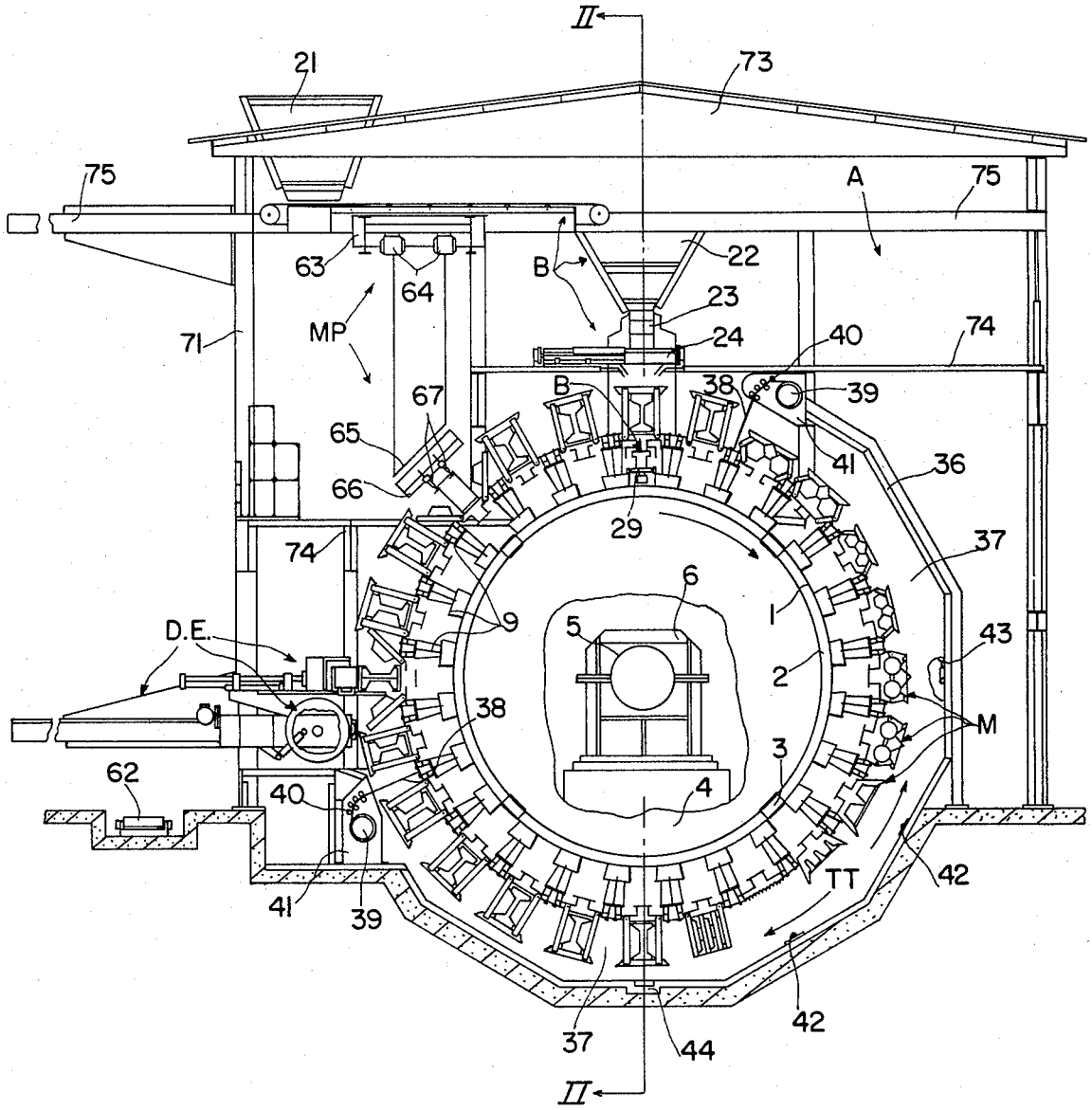
FIG. 1, of these drawings, is a cross-section along the line I—I of FIG. 2, of one embodiment of a rotary drum plant, according to the invention.
Figure 2:
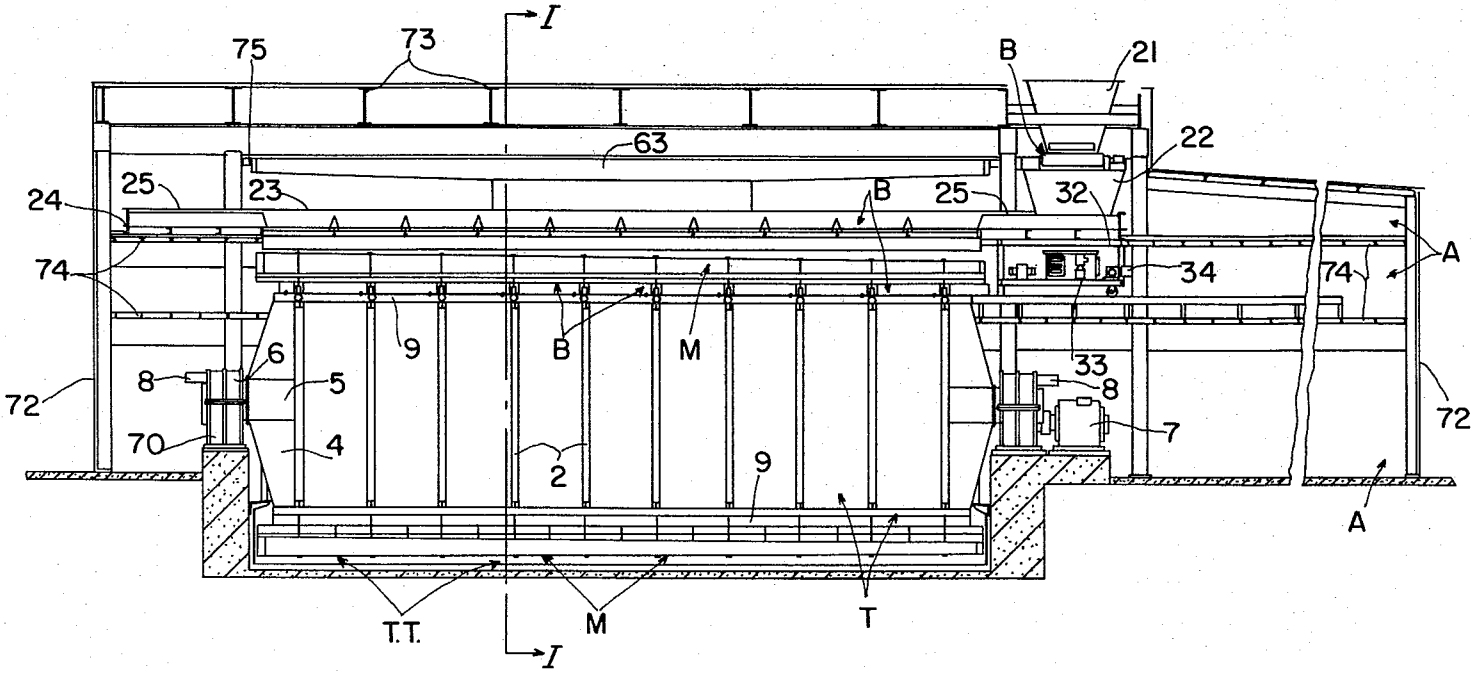
FIG. 2 is a longitudinal section along the line II—II of FIG. 1.
Figure 3:
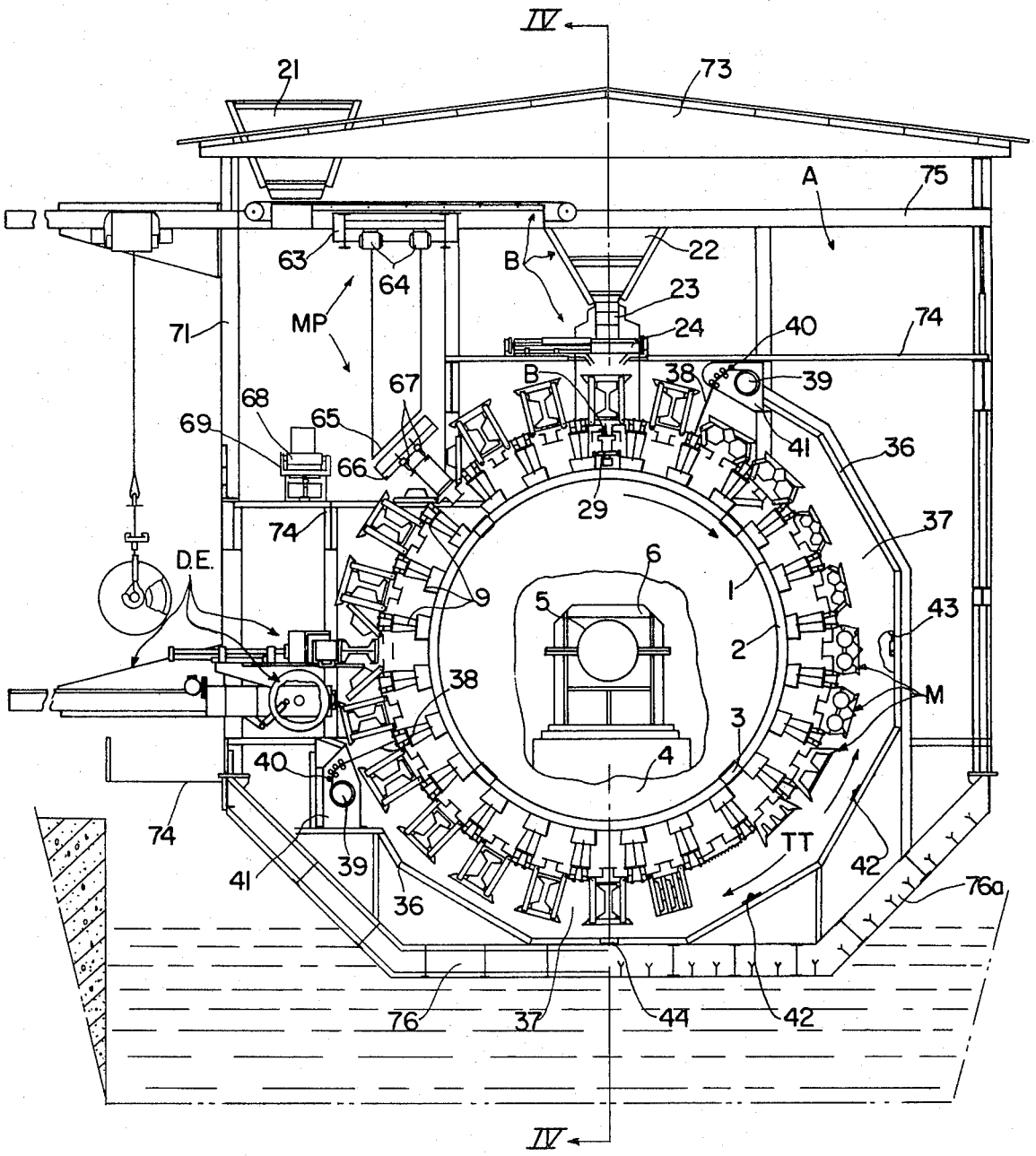
FIG. 3 is a cross-section along the line III—III of FIG. 4, of a floating plant with a rotary drum.

Referring to the drawings, and more particularly to FIGS. 1 and 3, there can be seen a rotary drum plant, fixed or floating, for the manufacture of a product p of concrete, reinforced concrete and/or of prestressed concrete.

Such a plant comprises:

- a rotary drum T, with a horizontal axis of rotation, equipped, on its outer periphery, with beams 9 with a composite profile forming a series of support benches for the molds and reinforcements;
- molding means M for various types of concrete products, these molding means being placed on the outer cylindrical surface of the drum;
- a concreting installation B, equipped with a common device for measuring out, distributing and compacting concrete run into the molding means M;
- a heat treatment installation T, comprising a hardening chamber through which the molds filled with concrete pass, at a constant rate, due to the rotation of the drum;
- a demolding and removal installation for the molded product DE, arranged advantageously at 270° with respect to the concrete installation B;
- an installation MP which permits the production, with minor adaptations, both the positioning of cores "a" for the reinforced concrete and armatures for the prestressed concrete;
- various accessory metallic structures visible in the drawings, notably for the construction of control stations, of offices, of cloak rooms, or of similar associated structures.

Figure 4:
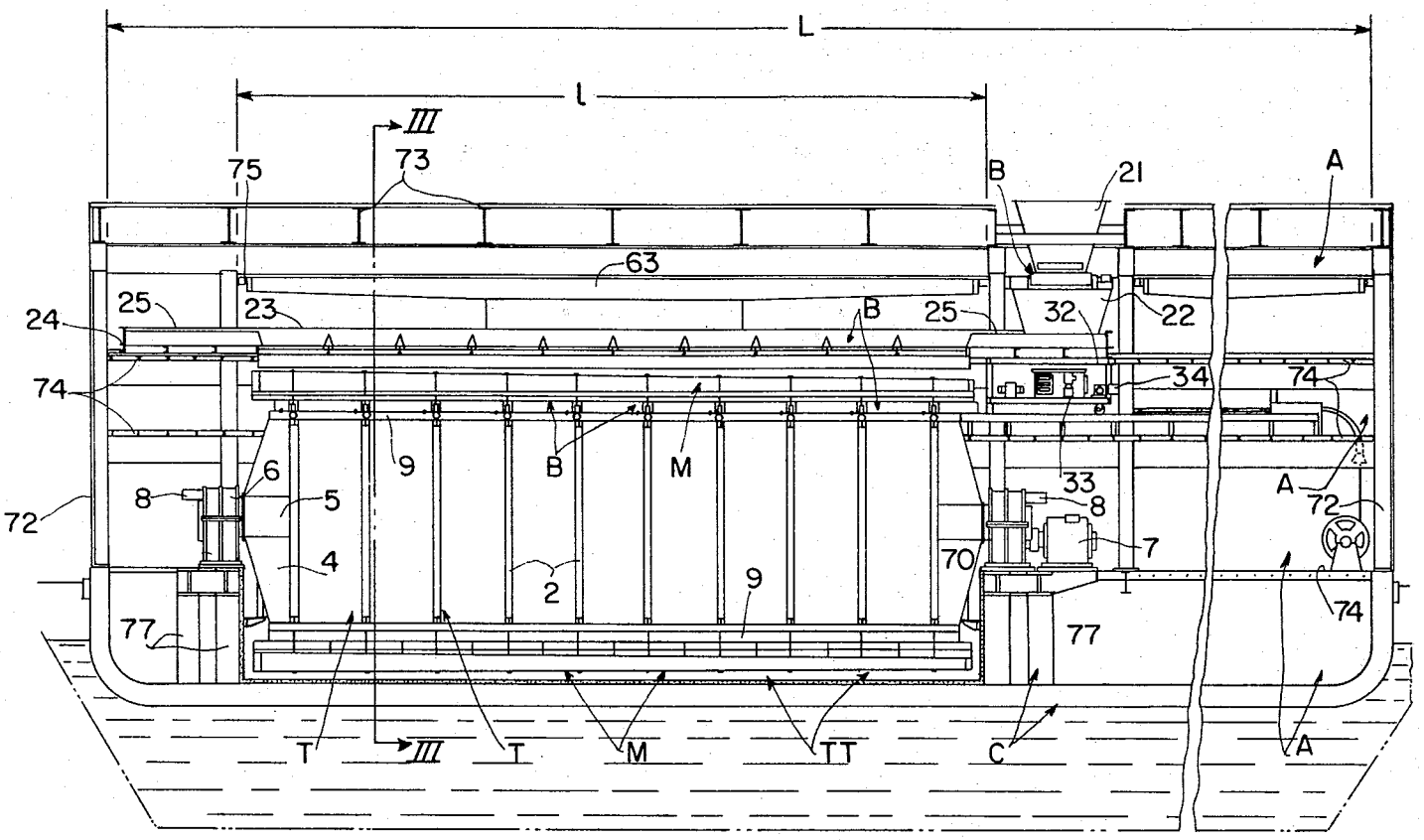
FIG. 4 is a longitudinal section along line IV—IV of FIG. 3.

In certain cases, the rotary drum can be mounted in a floating hull C (FIG. 4), with all the accessory installations of the plant, so as to produce a "rotary drum floating plant". The rotary drum Y (FIGS. 1 to 8), is constituted by a rotary structure having over its outer periphery beams with a composite profile 9, forming a series of mold support benches, welded parallel to the horizontal axis of rotation so as to reinforce the structure to render it capable of supporting not only the loads due to the molds filled with concrete, but also the forces arising from the tensioning of the armatures or cores or strands during the manufacture of prestressed concrete products.

Said rotary structure comprises curved steel plates 1 (see notably FIG. 8), reinforced by beams 2 and assembled by means 3, formed, for example, by linking plates, and by two head walls 4 (FIGS. 1 and 4) arranged in the form of a cylinder. At the two axial ends of the structure are provided two tubular support beams 5, fast to the walls 4, borne by two bearing members 6; rotary drive means 7 (FIGS. 2 and 4) for the drum and means 8 for blocking the rotation of this drum are also provided.

Each beam 9 with the composite profile (see notably FIG. 5) has the following characteristics:

- its cross-section has areas *9a, 9b* (FIG. 5) adapted to form a roller track parallel to the longitudinal axis of the drum, for the rolling and guiding of compacting means 29, 30 of the concrete run into the molds; these areas *9a, 9b* are directed, as seen in the drawings, in the peripheral direction of the drum; these areas are formed by the walls situated radially outwards of a base portion *9c*, of the cross-section, situated and fixed against the peripheral surface 1 of the drum;
- each beam 9 is equipped with means for fixing molds 16, 17, 18, 19 in a position situated radially outwards with respect to the roller paths *9a, 9b;* these fixing means comprise a series of dismountable chairs or hangers 10 provided with means for fixing and regulating 11 and elastic studs 12;
- each beam 9 has a sufficient mechanical strength to absorb the major portion of the the prestressing forces exerted on the cores in the case of the manufacture of prestressed concrete elements.

Advantageously, as seen in the drawings, notably in FIGS. 5 to 8, the cross-section of each beam 9 comprises, apart from the base portion *9c*, a T portion *9d* fixed through its central leg, oriented radially, on the base portion *9c;* the areas of the base portion *9a, 9b* situated on both sides of the central leg of the T constitute the above-said roller path for the compacting means. The cross-bar *9e* of the T is designed to receive the support means of the molds.

Gussets *9f*, separated from one another in the longitudinal direction, are situated in planes perpendicular to the longitudinal axis of the drum and are fixed, notably by welding, to the central legs and cross-pieces of the portion *9d* and to the upper portion of the base portion *9c*. The fastenings are provided preferably by welding.

The molding means M (FIGS. 5 to 8) include, at their portion turned towards the drum, a strengthening element 13 extending longitudinally and provided with attachment means *13a* for the compacting means 29, 30. This strengthening element 13 as well as the attachment means *13a* remain identical whatever the type of mold for the various types of products to be manufactured, so that the compacting means may be attached, under identical conditions, whatever the types of products to be manufactured. This strengthening element 13 may be consituted by two beams with a U-shaped cross-section, oriented longitudinally with their concavity turned in the opposite direction, towards the outside in the peripheral direction, the wings of the U being situated in planes parallel to the axis of the drum; these two beams are united by a series of assembly gussets 14.

Figure 5:
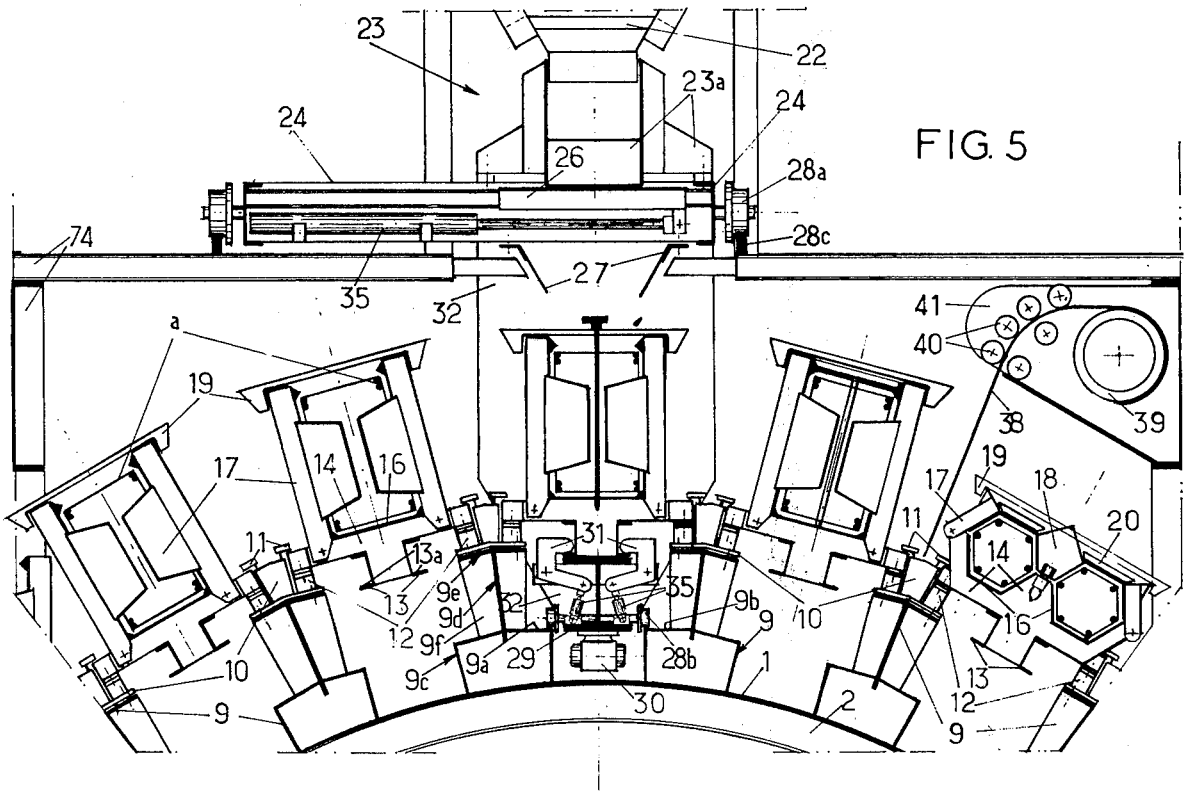
FIG. 5 shows in cross-section, on a larger scale, the concreting installation of a plant with a rotary drum, equipped with molds for the manufacture of posts for electrical lines and stakes.

The lower portion of the mold is connected to one or several shells designed according to the product to be manufactured, either as a fixed shell 15 (see notably FIG. 7) or as a mixed shell having fixed portions 16, and/or foldable portions 17 mounted on connecting hinges with the lower portion and/or movable shells 18 (see notably FIG. 5). Gripping means 19 notably to hold the folded back shells 17 in molded position, are provided. In certain cases, the molding means are provided with a cover 20 for the closing of the free surface of the concrete during the heat treatment.

The concreting installation B (FIGS. 1 to 5), comprises a supply hopper 21, a buffer hopper 22 and a carriage 23 movable in a direction parallel to the axis of the drum, above the highest generator of the drum. The length of the carriage 23, in the direction parallel to the axis of the drum, is substantially equal to that of the drum; the carriage 23 may be placed entirely above the drum, or be moved, in the longitudinal direction, entirely beyond the drum.

The carriage 23 includes two levels; the upper level of this carriage comprises one or several interchangeable containers 23*a*, borne by a frame 24; this frame is provided with two head platforms 25, with one or several closure flap-doors 26 and with an adjustable neck 27; the frame 24, in addition, is equipped with roller means 28*a* adapted to roll on rails 28*c* (FIG. 5) borne by a fixed frame.

The neck 27 of the frame 24 is adapted to come above the molding means M situated at the upper part of the drum, so as to permit the flow, by gravity, of the concrete into the molds.

The above-said carriage includes a second level or lower level provided with compacting means 29, 30, adapted to be introduced, by a longitudinal movement of the carriage, below molding means situated at the upper part of the drum.

The compacting means comprise a vibrating beam 29 provided with roller means 28*b*, adapted to roll on the roller tracks 9*a*, 9*b* and with two or several vibrators 30. The beam 29 is, in addition, equipped with attachment devices 31 of the said beam on the attachment means 13*a* of the strengthening element 13 of the molding means (FIG. 5). The upper level and the lower level of the carriage are connected by a framework 32 so as to be moved in a unit. The framework 32 is provided with a platform 33 supporting "to-and-fro" means 34 provided to move the two-level carriage in a "to-and-fro" movement, and with various equipment necessary for the automatic operation of the vibrators. The attachment devices 31 includes jacks 35 adapted to move bent arms gripping the strengthening element 13 against the vibrating beam.

It will thus be understood that the two-level carriage can occupy the working position for which the upper level of the carriage is above the molds stopped at the top of their circular trajectory, whilst the lower level of the carriage is situated below these molds, or in an output position for which the carriage is situated, in the longitudinal direction, entirely outside the drum.

In "forward" travel, said carriage brings the containers 23, filled with fresh concrete, above the molds, and the vibrating beam 29 below these molds. The stopping of the carriage in the working position actuates the attachment of said beam 29 to the strengthening element 13 by means of devices 31. The accomplishment of this operation of attachment actuates the opening of the flap-doors 26 and the pouring of fresh concrete into the molds; the starting of the vibrators 30 is also actuated. The duration of compacting produced by the vibrations is selected for each product according to the characteristics of the concrete used.

When the compacting is terminated, the stopping of the vibrators 30 is ordered, as well as the detachment of the beam 29; the flap-doors 26 are closed and the two-level carriage starts its return travel (from left to right in FIGS. 2 to 4) so as to emerge completely, in the longitudinal direction, with respect to the drum. During this return travel, the containers 23 pass below the hopper-buffer 22 and are filled with fresh concrete for the following casting operation. The platform 25 situated on the right hand side of the frame 24 ensures the closing of the hopper-buffer 22 during the period of time when the casting of the concrete in the molding means M takes place; the platform 25 situated at the left hand side of the frame 24, in FIGS. 2 and 4, ensures the closing of the hopper 22 when the carriage is completely outside the drum, and during the rotation of this drum by one step, which rotation brings the following molding means to the top of their circular path, for the casting of concrete in these molding means.

The heat treatment installation TT (see notably FIGS. 1 and 3) is constituted by a chamber closed towards the inside in the radial direction, by the drum itself whose peripheral surfaces is constructed by steel plates 1 which form a continuous cylinder; this chamber is, in addition, closed, radially outwardly by walls 36, notably with a polygonal cross-section; the chamber is closed at its heads, that is to say at its ends in the longitudinal direction, by screens 37 and, radially, by flexible movable curtains 28. These curtains 38 (FIG. 6) are provided with winding means 39, with guide means 40 and with raising means 41. The heat treatment chamber TT is provided with distributing means 42 for a thermal agent (steam, hot water, or the like), with regulating means 43 for the flow rate of the heat of the thermal agent and with recovering means 44 for this thermal agent; the hardening of the concrete can thus be carried out progressively with the passage of the molds, filled with concrete, through this heat treatment chamber. This passage is obtained by the rotation of the rotary drum assembly, at a predetermined rate.

The installation for demolding and removal of the molded product DE (FIGS. 1, 3 and 6) is advantageously placed at 270° with respect to the concrete casting station, in the direction of rotation of the drum represented by an arrow in FIGS. 1 and 3. This demolding installation comprises a frame formed by a beam 45 connecting two head screens 46; this frame is, in addition, provided with roller means 47 so as to be displaceable on a roller track 47*a*, in a radial direction situated in the horizontal plane passing through the axis of the drum. Displacement means 48 (for example a motor, gear, rack unit) are provided to permit a "to-and-fro" motion to be communicated to the frame in the radial direction. The head screens 46 of the frame serve as a support for a rotary beam 49 rotatably mounted in two bearings 50 supported by the head screens. Two jacks 51 articulated, at one end, on a pivot fast to the frame and, at their other end, on a pivot fast to the beam 49 are provided to actuate a rotation over an angle of 90°, in one direction or the other of this beam. Said beam 49 is equipped with gripping means 53, 54, 55, for the molded products p, adapted to grip these products and to remove them.

The gripping means are supported by gussets 52 fast to the beam 49; these gripping means comprise, on the one hand, a series of suckers 53 mounted by means of interchangeable heads 54 on a longitudinal beam 55 which may be moved radially, with respect to the drum. The beam 55 is equipped with bearing rollers 57 and with guide means 56 for its movement; means 58, notably formed by jacks, are provided to ensure "to-and-fro" movement of the beam 55. The gripping means comprise, on the other hand, support elements 59, formed by a series of fingers, mounted in guides 60 and provided with means 61, such as jacks, adapted to ensure a "to-and-fro" movement; these fingers 59 may be slid beneath the hardened products on the demolding (see FIG. 6).

Figure 6:
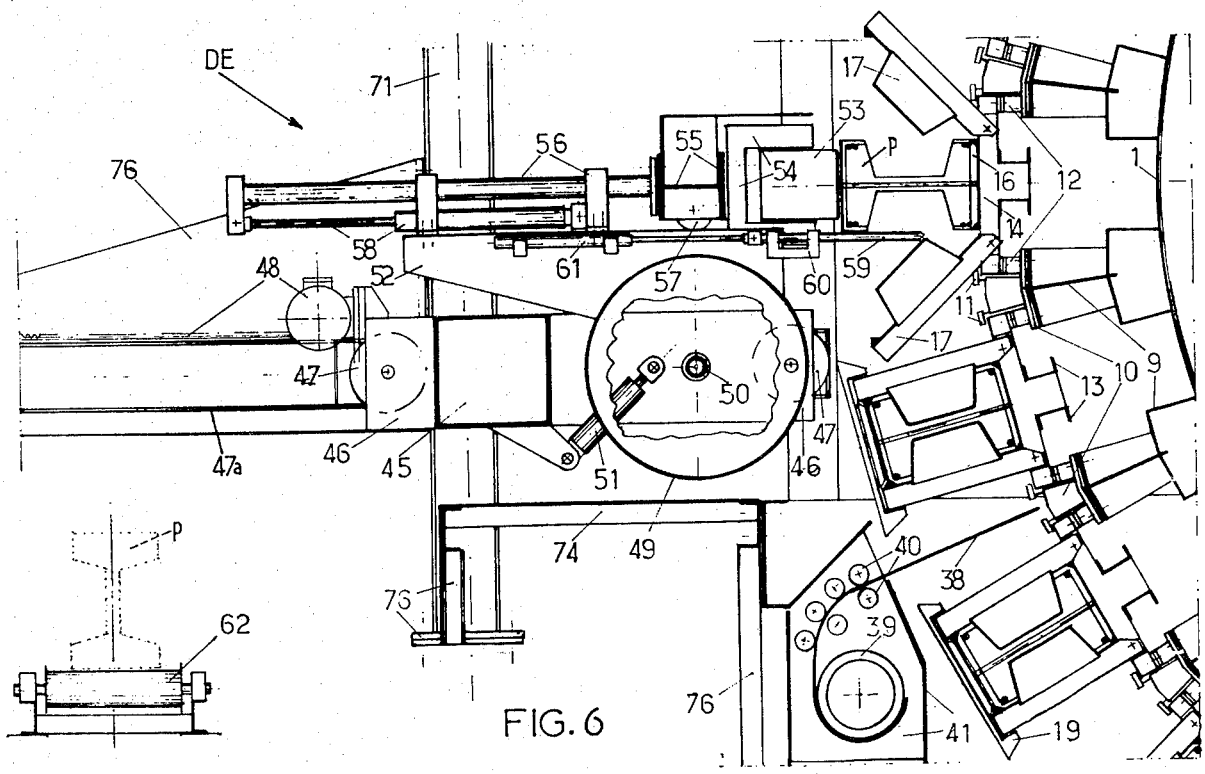
FIG. 6 is a cross-section, on a larger scale, of the demolding and removal installation for the molded products formed, in the example shown, by posts for electrical cables.
Figure 7:
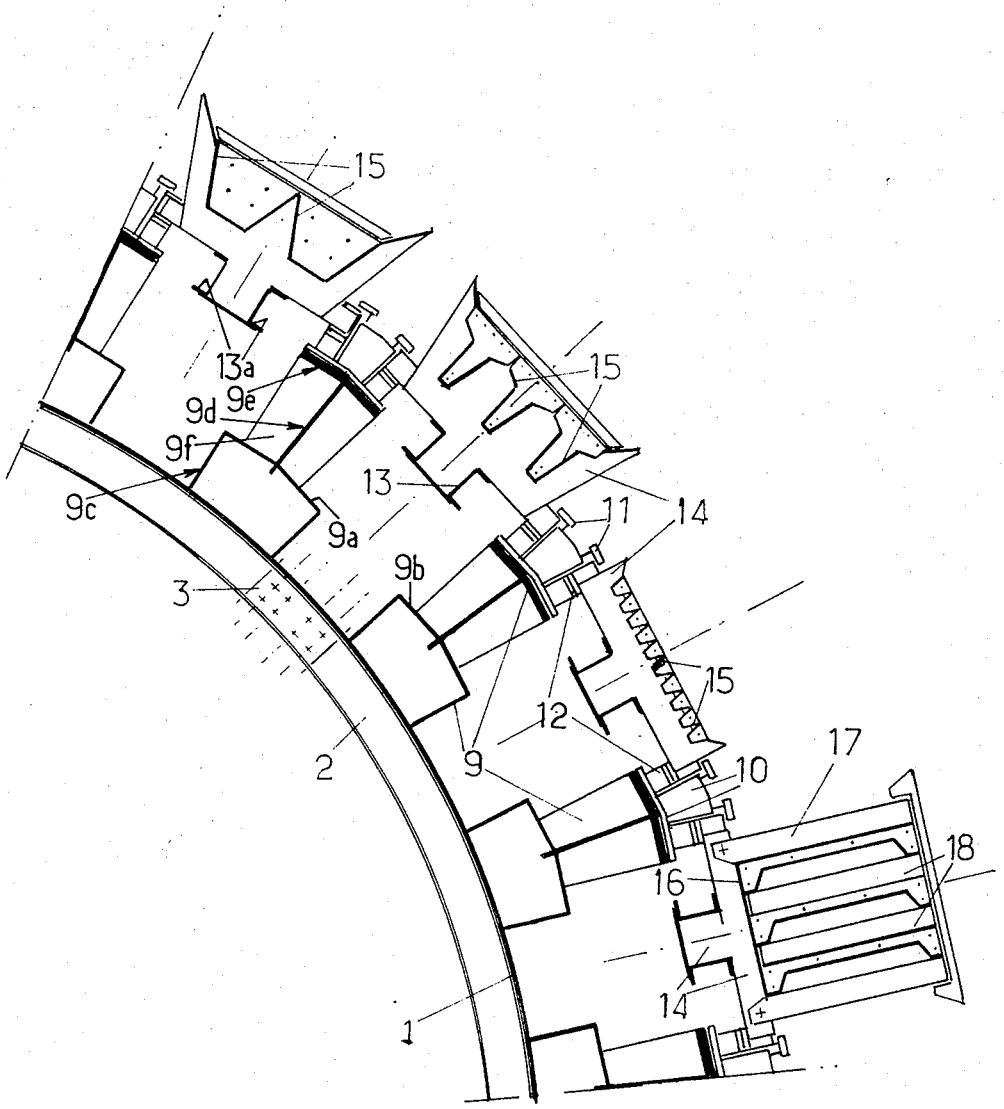
FIG. 7 is a partial cross-section, on a larger scale, of a rotary drum equipped with molds for the manufacture of railway sleepers, of T girders, of vine stakes and of ribbed slabs.
Figure 8:
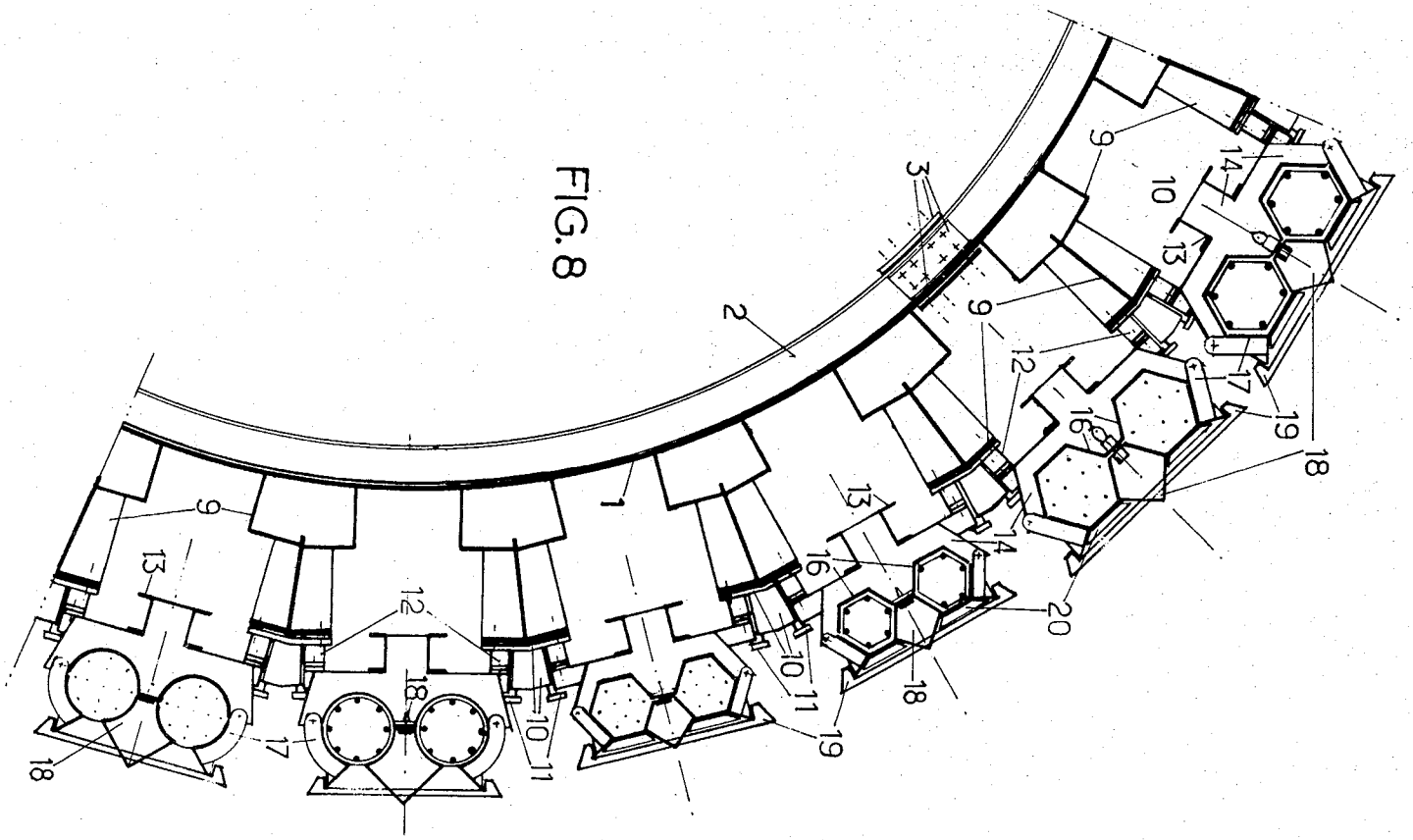
FIG. 8, lastly, is a partial cross-section, on a larger scale, of a rotary drum equipped with molds.

The operation of this demolding installation will be seen clearly from FIG. 6. On the opening of the mold, the products p are supported by the fingers 59 and are seized by the suckers 53. The jacks 58 then move the beam 55 from the right to the left of FIG. 6, in a horizontal direction to disengage the product p from the mold. Then, the means 48 ensure the movement of the whole of the frame 45, 46 of the beam 49, of the beam 55 and of the product p.

When the withdrawal of the frame is sufficient, the rotation by 90° of the beam 49, in clockwise direction, is controlled by the jacks 51 so as to place the gussets 52 in a vertical position; the jacks 58 whose axis is then vertical, then orders the descent of the beam 55 until the product p comes into the position shown in dashed line in FIG. 6, to rest on a roller chain 62 or on another means of transportation, for the removal of the products. The vacuum which, until now, had been maintained in the suckers 53 to ensure the gripping of the product p is suppressed; the product becomes released with respect to the sucker means which are restored into their initial position.

The installation MP (FIGS. 1 and 3), for the positioning of the cores, includes a bridge crane 63 provided, on the one hand, with a lifting device 64, which can move various loads, by giving them a desired inclination, and on the other hand with a positioning device equipped with a frame 65 having a series of beams 66 adjustable in the longitudinal direction, and a series of attachment parts 67, adjustable, in their turn, along the width, that is to say along the peripheral direction of the drum.

The attachment parts 67 are interchangeable so as to permit the installation MP to be used both for the positioning of the various cores and for the mounting and loading of the molds, by minimal adaptation means.

It is possible, in certain cases, as seen in FIG. 3, to use for the assembly of the cores an assembly production line provided with roller means 68 and with a series of platforms 69 for the support and movement to the vertical of yokes adapted to connect the longitudinal rods of the cores.

Advantageously the rotary drum plant is constructed with dismountable steel sub-assemblies, the gauge of each sub-assembly being such that transportation by road of the sub-assembly is possible. These sub-assemblies include: two frames 70 for the support of the drum, two lateral walls 71, two or several front walls 72, various roofing elements 73, various working platforms 74, roller beams 75 and various mounting and protection elements.

With the same sub-assemblies, it is possible to ensure the mounting of a fixed plant, on concrete foundations, or of a floating plant by resorting, in the latter case, either to a barge, or to a hull which can be formed of metal 76 or of metal and reinforced concrete **76*a***, the sub-assemblies being mounted in this hull.

In the case of a floating plant, the mounting is carried out so that the axis of the rotary drum is oriented in the direction of the length of the barge or of the floating hull; this hull is equipped with transverse walls 77 (FIG. 4) provided on the bottom of the hull and serving as a support for the bearings of the rotary drum. The inner length L of the hull is at least equal and preferably greater than double the length of the rotary drum to permit the disengagement, totally, in the longitudinal direction, of the two-level carriage 23. In the example shown in FIG. 4, the rotary drum is situated in the left hand portion of the hull; the right hand portion of this hull, which permits the disengagement of the carriage 23, forms a space useful for the location of a series of annexes A(such as offices, stores, various workshops, various depots, handling means, concrete producing units, boilers, electric power generators).

These annexes A may also be provided for fixed plants; such annexes give the plant thus-equipped a better autonomy.

I claim:

1. Plant for the manufacture of concrete, reinforced concrete and/or prestressed concrete products comprising a rotary drum with a horizontal axis of rotation, lined over its outer cylindrical surface with molding means and adapted to pass said molding means during its rotation, in front of various working stations, notably stations for concreting, for hardening, for demolding and for positioning cores, wherein the drum is equipped with beams with a composite profile fixed, notably by welding, longitudinally, over the outer periphery of the drum; said beams:

(1) having a cross-section which has areas adapted to form a roller track parallel to the longitudinal axis of the drum for the rolling and guidance of the compacting means for the concrete, (2) being equipped with fastening means for the molds in a position situated radially outwards with respect to the said roller track, (3) having, in addition, sufficient mechanical strength to absorb the major part of the prestressing forces exerted on the cores in the case of the manufacture of prestressed concrete elements.

2. Plant according to claim 1, wherein the cross-section of each beam is composed by a base portion, substantially rectangular, situated against the peripheral surface of the drum and by a T-shaped portion fixed, through its central leg, at mid-width on the base portion, the areas of the base portion situated on both sides of the central leg of the T serving as a roller track, whilst the cross arm of the T is designed to receive support means, notably elastic, for molds.

3. Plant according to claim 1 wherein the molding means include at their portion turned towards the drum, a strengthening element extending longitudinally, provided with attachment means for the compacting means, this strengthening element as well as the attachment means being identical whatever the type of mold for the various kinds of products to be manufactured, the lower portion of the mold being connected, notably by articulations, to the lateral shells whose shape is determined by the type of product to be produced.

4. Plant according to claim 2, wherein the molding means include at their portion turned towards the drum, a strengthening element extending longitudinally, provided with attachment means for the compacting means, this strengthening element as well as the attachment means being identical whatever the type of mold for the various kinds of products to be manufactured, the lower portion of the mold being connected, notably by articulations, to the lateral shells whose shape is determined by the type of product to be produced.

5. Plant according to claim 1, wherein the concreting installation includes a carriage whose length, in a direction parallel to the axis of the drum is substantially equal to that of the drum, this carriage including two levels and being situated above the highest generator of the drum, the upper level of this carriage including at least one container to receive concrete and means to permit the flow of the concrete into the molds, said carriage being adapted to roll, at its upper level, over roller means borne by a fixed frame, said carriage including a second level or a lower level provided with compacting means adapted to roll on the roller track of beams fast to the drum, attachment means being provided to lock the compacting means on the bottom of the molds during the compacting phase, the two levels of the carriage being connected by a framework, and "to-and-fro" means being provided to move the carriage so that it can occupy a working position for which its lower level is above the molds stopped at the top of their path, whilst the lower level of the carriage is situated below these molds, or an output position for which the carriage is situated, in the axial direction, entirely outside the drum.

6. Plant according to claim 1, comprising a heat treatment installation constituted by a chamber, closed toward the inside by the drum itself, towards the outside (in the radial direction) by walls notably polygonal, at the ends in the axial direction by screens and radially by movable curtains provided with means for winding, guiding and raising them, this heat treatment chamber being provided with means for distributing, regulating and recovery of the thermal agent.

7. Plant according to claim 1, wherein the demolding and removal installation includes a frame adapted to be moved in a radial direction, notably in the horizontal plane passing through the axis of the drum, this frame bearing a rotary beam on which are mounted gripping means for the stripped product, this beam being rotatable, with the gripping means so as to ensure the removal of the molded products gripped by the gripping means.

8. Plant according to claim 7, wherein the gripping means comprise a series of suckers mounted by means of interchangeable heads on a longitudinal beam which can be moved radially with respect to the drum, these gripping means being combined with slidable support elements, adapted to be slid beneath the hardened products during the stripping.

9. A plant according to claim 1, wherein the core positioning installation includes a lifting device which can move the various loads in a desired inclination and a positioning device equipped with a frame having a series of beams adjustable in the longitudinal direction and a series of attachment parts adjustable in the direction of the width.

10. Plant according to claim 1, mounted in a floating hull or barge so that the axis of the drum is oriented in the direction of the length of the hull, which is equipped with transverse walls serving as a support for the bearings of the drum, the length of the hull being at least equal to double the length of the drum, a space being formed for the implantation of a series of annexes.

* * * * *